US010188181B2

(12) United States Patent
Yamamoto et al.

(10) Patent No.: US 10,188,181 B2
(45) Date of Patent: Jan. 29, 2019

(54) FASTENER STRINGER AND SLIDE FASTENER PROVIDED WITH SAME

(71) Applicant: YKK Corporation, Tokyo (JP)

(72) Inventors: Syoso Yamamoto, Toyama (JP); Hiroshi Goto, Toyama (JP); Tatsuo Mizuno, Toyama (JP)

(73) Assignee: YKK Corporation (JP)

( * ) Notice: Subject to any disclaimer, the term of this patent is extended or adjusted under 35 U.S.C. 154(b) by 78 days.

(21) Appl. No.: 15/506,385

(22) PCT Filed: Dec. 25, 2014

(86) PCT No.: PCT/JP2014/084206
§ 371 (c)(1),
(2) Date: Feb. 24, 2017

(87) PCT Pub. No.: WO2016/031094
PCT Pub. Date: Mar. 3, 2016

(65) Prior Publication Data

US 2017/0251772 A1 Sep. 7, 2017

(30) Foreign Application Priority Data

Aug. 27, 2014 (WO) ..... PCT/JP2014/072504

(51) Int. Cl.
*A44B 19/42* (2006.01)
*A44B 19/06* (2006.01)
(Continued)

(52) U.S. Cl.
CPC ..... *A44B 19/42* (2013.01); *A44B 19/06* (2013.01); *A44B 19/34* (2013.01); *A44B 19/403* (2013.01); *A44C 27/006* (2013.01)

(58) Field of Classification Search
CPC ..... A44B 19/06; A44B 19/34; A44B 19/42; A44B 19/403; A44B 19/02; A44B 19/04; C25D 7/02
See application file for complete search history.

(56) References Cited

U.S. PATENT DOCUMENTS 2,591,042 A 4/1952 Berman et al.
2,790,756 A * 4/1957 Cohn ..... C25D 7/02 204/199
(Continued)

FOREIGN PATENT DOCUMENTS

CN 101608328 A 12/2009
CN 203262439 U 11/2013
(Continued)

OTHER PUBLICATIONS

International Search Report, PCT International Patent Application No. PCT/JP2014/084206, dated Mar. 31, 2015.
(Continued)

*Primary Examiner* — Robert Sandy
(74) *Attorney, Agent, or Firm* — Kilpatrick Townsend & Stockton LLP

(57) ABSTRACT

A fastener stringer includes a row of elements on which cured coating film is formed at sites where it is difficult to be coated by a roll coating method, preferably over the entire exposed surface, without incorporating any conductive wire in a fastener tape. A fastener stringer includes a row of elements and a fastener tape, at least one side edge of the fastener tape having insulation properties, the row of the elements being attached to the one side edge of the fastener tape, wherein each element includes a pair of leg portions and a head portion, the head portion having an engaging region for engaging with an opposing element when constructing a fastener chain, and wherein cured coating film is
(Continued)

formed at least at a center portion in a front and back direction of the fastener tape on an end surface of the head portions.

16 Claims, 3 Drawing Sheets

(51) Int. Cl.

| | |
|---|---|
| ***A44B 19/34*** | (2006.01) |
| ***A44B 19/40*** | (2006.01) |
| ***A44C 27/00*** | (2006.01) |

(56) References Cited

U.S. PATENT DOCUMENTS

| | | | | | |
|---|---|---|---|---|---|
| 2,911,346 | A | * | 11/1959 | Cohn | C25D 7/02 24/411 |
| 2,991,528 | A | * | 7/1961 | McNamara | A44B 19/42 24/405 |
| 4,473,453 | A | | 9/1984 | Takahashi et al. | |
| 4,937,922 | A | | 7/1990 | Okazaki | |
| 5,035,029 | A | | 7/1991 | Horita et al. | |
| 5,397,319 | A | | 3/1995 | Suzuki et al. | |
| 5,469,605 | A | | 11/1995 | Horikawa | |
| 5,658,679 | A | | 8/1997 | Shiratori | |
| 2003/0110600 | A1 | * | 6/2003 | Kikukawa | A44B 19/00 24/399 |
| 2014/0182092 | A1 | | 7/2014 | Seki | |

FOREIGN PATENT DOCUMENTS

| | | | |
|---|---|---|---|
| JP | 58-025497 | A | 2/1983 |
| JP | 01-160502 | A | 6/1989 |
| JP | 02-270996 | A | 11/1990 |
| JP | 03-012103 | A | 1/1991 |
| JP | H05-123209 | A1 | 5/1993 |
| JP | 068509/1994 | | 9/1994 |
| JP | 08-024019 | A | 1/1996 |
| WO | 2013/027281 | A1 | 2/2013 |

OTHER PUBLICATIONS

International Preliminary Report on Patentability, PCT International Patent Application No. PCT/JP2014/084206, dated Mar. 9, 2017.

* cited by examiner

Cross Section

Longitudinal Section

FASTENER STRINGER AND SLIDE FASTENER PROVIDED WITH SAME

This application is a national stage application of PCT/JP2014/084206, which claims priority to PCT/JP2014/072504, both of which are incorporated herein by reference.

TECHNICAL FIELD

The present invention relates to a fastener stringer having cured coating film formed on the surface of elements. The present invention also relates to a slide fastener provided with the fastener stringers.

BACKGROUND ART

A slide fastener is a tool for opening and closing an article used in familiar daily necessities such as clothing items, bags, shoes and miscellaneous goods, as well as industrial goods such as water storage tanks, fishing nets and space suites. The slide fastener is mainly comprised of three parts of a pair of long fastener tapes, a number of elements which are engaging portions of the fastener and are attached along one side edge of each tape, and a slider for controlling opening and closing of the fastener by engaging or separating the elements opposed to each other.

Recently, customer needs for the slide fasteners have diversified, and high added value by means of glazed finishing or various coloring of metallic elements has been developed. For this reason, there have been many situations where gloss polishing or chemical coloring is applied to the metallic elements. In this case, when used for leather goods such as wallets and jackets, discoloration of the elements may occur due to sulfides resulting from the leather. In addition, there is concern that the film on the elements may be scraped with sliding of the slider. Therefore, the surface of the elements is protected with a clear lacquer using a roll coater after the gloss polishing or chemical coloring. For example, Chinese Utility Model No. 203262439 (Patent Document 1) discloses a technique of applying a lacquer to the elements by the roll coating method.

Further, it is known in the art that, in relation to the technique for subjecting the metallic elements to various coloring, a conductive wire is incorporated along the side edge portion where a row of elements of the fastener tape is arranged, and electrodeposition coating is then performed. An example of prior patents disclosing this type of technique includes Japanese Patent Application Public Disclosure (KOKAI) No. H05-123209 A1 (Patent Document 2).

CITATION LIST

[Patent Document 1] Chinese Utility Model No. 203262439

[Patent Document 2] Japanese Patent Application Public Disclosure (KOKAI) No. H05-123209 A1

SUMMARY OF INVENTION

Problem to be Solved by the Invention

In the surface treatment with the roll coating method, the coating material adheres only to the contact portion between the roll and the elements, and so it is difficult to form a coating film having a required thickness on the entire exposed surface of the element having a small and complicated shape. Further, when an aqueous coating material is used in the roll coating method, the coating film is easily eluted by washing with water. Therefore, no aqueous coating material can be used, and it is thus necessary to use an organic solvent-based coating material. However, the organic solvent-based coating material causes a problem that the coating material is difficult to be cleaned when the coating material adheres to the fastener tape. In the technique of electrodeposition coating, it is possible to coat the entire exposed surface of the elements, but it is necessary to incorporate the conductive wire in the fastener tape. Therefore, there is a problem that the number of the steps and material costs increase, thereby increasing production costs. There is also a problem that inventory management is complicated due to an increase in the kind of fastener tapes.

The present invention has been made under the above circumstances. An object of the present invention is to provide a fastener stringer having a row of elements on which cured coating film is formed at sites where it is difficult to be coated by the roll coating method, preferably over the entire exposed surface, without incorporating any conductive wire in a fastener tape. Another object of the present invention is to provide a method for electrodeposition-coating the row of elements attached to the fastener tape.

Means for Solving the Problem

In one aspect, the present invention relates to a fastener stringer comprising a row of elements and a fastener tape, at least one side edge of the fastener tape having insulation properties, the row of the elements being attached to the one side edge of the fastener tape, wherein each element comprises a pair of leg portions for holding the fastener tape from front and back sides; and a head portion connecting each leg portion while straddling the one side edge of the fastener tape, the head portion having an engaging region for engaging with an opposing element when constructing a fastener chain; and wherein cured coating film is formed in 50% or more of a total number of the elements at least at a center portion in a front and back direction of the fastener tape on an end surface of the head portion.

In one embodiment of the fastener stringer according to the present invention, the head portion of each element has an engaging convex portion and an engaging concave portion for engaging with the opposing element when constructing the fastener chain, wherein the engaging convex portion is formed so as to protrude toward one side in an element arranging direction, the engaging concave portion is formed on the other side opposite to the engaging convex portion in the element arranging direction, and the cured coating film is formed in 50% or more of a total number of the elements at least on the engaging concave portion.

In another embodiment of the fastener stringer according to the invention, the cured coating film is formed on an entire conductive exposed surface of each element.

In yet another embodiment of the fastener stringer according to the present invention, in each element, a maximum thickness difference of the cured coating film between top surface centers of the both leg portions is within 2 μm.

In yet another embodiment of the fastener stringer according to the present invention, when measuring a thickness of the cured coating film at a top surface center of each leg portion in all the elements of the fastener stringer, a difference between maximum and minimum values of the thickness of the cured coating film is within 10 μm.

In yet another embodiment of the fastener stringer according to the present invention, when measuring a thickness of the cured coating film at a top surface center of each leg portion in all the elements of the fastener stringer, a standard deviation of the thickness of the cured coating film is within 3 μm.

In yet another embodiment of the fastener stringer according to the present invention, when measuring a thickness of the cured coating film at a top surface center of each leg portion in all the elements of the fastener stringer, an average value of the thickness of the cured coating film is from 5 to 15 μm.

In yet another embodiment of the fastener stringer according to the present invention, when measuring a thickness of the cured coating film at a top surface center of each leg portion in all the elements of the fastener stringer, a coefficient of variation of the thickness of the cured coating film is 0.3 or less.

In yet another embodiment of the fastener stringer according to the present invention, the cured coating film comprises a resin component of one or more thermosetting resins selected from polyester-based resin, acrylic-based resin and fluorine-based resin.

In yet another embodiment of the fastener stringer according to the present invention, the cured coating film contains a pigment and/or a dye.

In another aspect, the present invention relates to a method for electrodeposition-coating a row of elements attached to a fastener tape, comprising the steps of:

1) preparing a fastener stringer comprising the row of the elements and the fastener tape, at least one side edge of the fastener tape having insulation properties, the row of the elements having conductivity at least on their exposed surface and being attached to the one side edge of the fastener tape, or preparing a fastener chain in which the rows of the elements of a pair of the fastener stringers are engaged with each other;

2) sequentially immersing the row of the elements in a positively or negatively charged aqueous coating material bath while conveying the fastener stringer or the fastener chain; and 3) forming cured coating film on the elements by bringing the elements immersed in the aqueous coating material bath into contact with an electrode having a charge opposite to that of the aqueous coating material bath.

In one embodiment of the method for the electrodeposition-coating the row of the elements according to the present invention, the method further comprises, after the step 3), the step 4) of water-washing and removing the aqueous coating material adhered to the fastener tape.

In one embodiment of the method for electrodeposition-coating the row of the elements according to the present invention, the method further comprises, after the step 3), the step 5) of baking the coating film to cure the coating film.

In yet another aspect, the present invention relates to a fastener chain in which the rows of the elements of a pair of the fastener stringers according to the present invention are engaged with each other.

In yet another aspect, the present invention is a slide fastener comprising the fastener stringers according to the present invention.

In yet another aspect, the present invention is an article comprising the slide fastener according to the present invention.

Effects of the Invention

According to the present invention, it is possible to provide a slide fastener having a row of elements on which cured coating film is formed at sites where it is difficult to be coated by the roll coating method, preferably over the entire exposed surface, thereby having higher uniformity of the film thickness. Therefore, the present invention will contribute to the quality stabilization of the slide fastener having elements with high added value by means of highly glazed finishing and various coloring. In addition, the method for electrodeposition-coating the row of the elements according to the present invention will contribute to reduction in production costs because it is not necessary to incorporate any conductive wire into the fastener tape. Further, the method will allow removal of the coating material by means of washing with water when the coating material adheres to the fastener tape, because the method uses the aqueous coating material.

MODES FOR CARRYING OUT THE INVENTION

Figure 1:
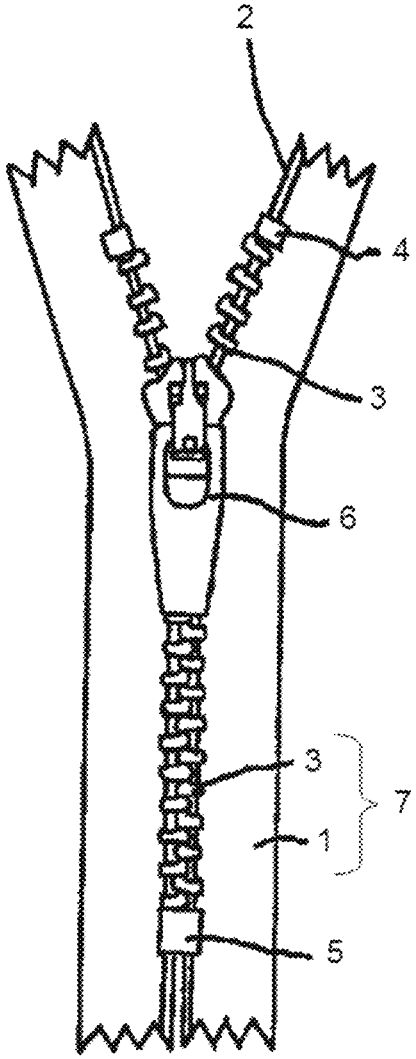
FIG. 1 is a schematic view of a slide fastener.

An example of the slide fastener according to the present invention will be specifically described with reference to Figures. FIG. 1 is a schematic view of the slide fastener. As shown in FIG. 1, the slide fastener comprises a pair of fastener tapes 1 each having a core portion 2 formed on one side edge; a row of elements 3 attached to the core portion 2 of each fastener tape 1 by means of caulking and arranged at a predetermined space in the core portion; an upper stopper 4 and a lower stopper 5 fixed to the core portion 2 of each fastener tape 1 by means of caulking at the upper end and the lower end of the row of elements 3, respectively; and a slider 6 placed between a pair of opposing elements 3 and configured to be slidable in the up and down direction so as to engage and disengage the pair of the elements 3.

A material in which the row of the elements 3 is attached along one side edge of one fastener tape 1 is referred to as a fastener stringer, and a material in which the rows of the elements 3 of a pair of fastener stringers are engaged with each other is referred to as a fastener chain 7. It is noted that the lower stopper 5 may be an openable, closable and fittingly insertable tool consisting of an insert pin, a box pin and a box body, so that the pair of slide fastener chains can be separated by separating operation of the slider.

In the fastener tape 1 used in the present invention, at least one side edge where the row of the elements 3 is attached has insulation properties, and the conductive wire as disclosed in Japanese Patent Application Public Disclosure (KOKAI) No. H05-123209 A1 (Patent Document 2) is not incorporated. In other words, the present invention can use common fastener tapes, and does not require any special specification, so that there is no increase in the production costs or burden of inventory management due to increases in the number of steps and material costs. In a typical embodiment of the fastener tape used in the present invention, the entire fastener tape is made of an insulating material.

The insulating materials for use in the fastener tape 1 are not limited, but they can be natural resins or synthetic resins. Generally, fibers made of these materials are woven or knitted to form a fastener tape. Typically, polyesters, polyamides, polypropylenes, acrylic resins and the like can be used as the materials for the fastener tape 1. Among them, polyester tapes are preferred in terms of good chain crosswise strength.

The cured coating film may not be formed on the surface which is hidden in contact with the fastener tape 1, among the surface of the elements 3. The cured coating film is generally not formed on such a surface, but the cured coating film is preferably at least formed on the surface which is exposed to the outside, in terms of both aesthetics and function. Therefore, in the present invention, it is desirable that all the exposed surface of each element 3 has conductivity, and it is desirable that 50% or more, and preferably 70% or more, and more preferably 90% or more, and still more preferably 100% of the total number of the elements preferably form the cured coating film on the entire exposed surface of each element by means of electrodeposition coating. The entire surface of each element 3 may have conductivity. Examples of the elements having the conductivity on the surface thereof include, but not limited to, metallic elements and resin elements with plated surface. Materials of the metallic elements include, but are not limited to, copper, copper alloys (red brass, nickel silver, etc.), aluminum alloys, stainless steel, titanium, zinc and the like. For the resin elements with plated surface, nickel or the above-mentioned metals can be selected as the plating material, and materials of resins as base materials include polyacetals, polyesters, polyamides, polypropylenes, acryl resins and the like. Among them, polyacetals are preferred in terms of the strength. Surface treatments such as a plating treatment, a chemical conversion treatment and a glossy polishing can be further performed on the metal surface or plated surface in advance before the electrodeposition coating, as long as they do not have any significant adverse effect on the conductivity of the surface of the elements.

Figure 2:
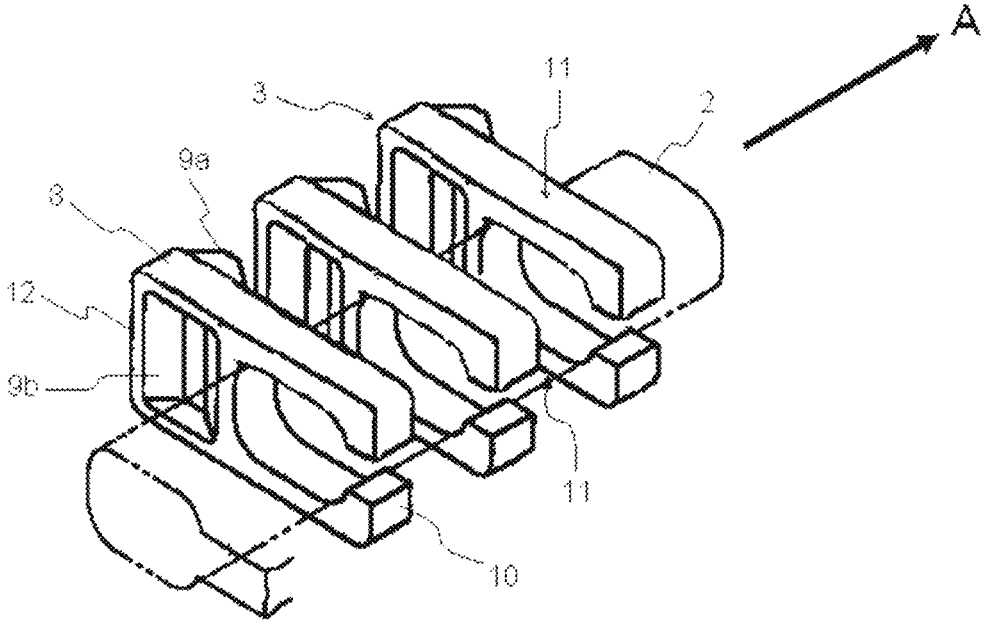
FIG. 2 is a schematic view showing a state where elements are attached to a core portion of a fastener tape.

Referring to FIG. 2, it shows a schematic view showing a state where three elements 3 arranged at a predetermined space are attached to the core portion 2 of the fastener tape 1. Each element 3 has a pair of leg portions 10 for holding the fastener tape 1 from the front and back sides, and a head portion 8 connecting each leg portion while straddling the one side edge of the fastener tape, the head portion 8 having an engaging region (an engaging convex portion 9*a* and an engaging concave portion 9*b* in FIG. 2) for engaging with an opposing element when constructing a fastener chain. The engaging convex portion 9*a* is formed so as to protrude toward one side in the element arranging direction A as shown in FIG. 2, and the engaging concave portion 9*b* is formed on the other side opposite to the engaging convex portion 9*a* in the element arranging direction.

When the coating film is formed on the elements by adopting the coating film forming method using the roll coater as described in Chinese Utility Model No. 203262439 (Patent Document 1) for the fastener stringer or the fastener chain, the coating material is supplied only from the direction of the front and back of the fastener tape 1, so that the coating material does not reach the vicinity of the center in the front and back direction of the fastener tape 1 and the engaging concave portion 9*b*, among the surface of each element, resulting in the sites where the coating film is not formed, and resulting in great unevenness of the thickness of the coating film. However, in the present invention, the cured coating film can be formed on the entire exposed surface of the elements 3 including the vicinity of the center portion in the front and back direction of the fastener tape 1 and the engaging concave portion 9*b*.

For example, the central portion 12 in the front and back direction of the fastener tape on the end surface (head tip surface) of the element head portion 8 and the engaging concave portion 9*b* are the most difficult sites to form the coating film by the roll coating method. However, according to the present invention, 50% or more, and preferably 70% or more, and more preferably 90% or more, and even more preferably 100% of the total number of the elements can have the cured coating film at least at the central portion 12 in the front and back direction of the fastener tape on the end surface of the element head portion 8. Further, according to the present invention, 50% or more, and preferably 70% or more, and more preferably 90% or more, and still more preferably 100% of the total number of the elements can have the cured coating film at least on the engaging concave portion 9*b* of the element head portion 8. It is thus completely unprecedented that the majority of the elements attached to the fastener tape have the cured coating film at the central portion 12 in the front and back direction of the fastener tape on the end surface of the element head portion 8, and further on the engaging concave portion 9*b* of the element head portion 8, and it is considered that the product according to the present invention would be recognized as an epoch-making product even in the fastener market. The thickness of the cured coating film on at least one or preferably both of these sites can be 1 μm or more, and preferably 3 μm or more, and more preferably 5 μm or more, if necessary. Furthermore, according to the invention, in the elements of 50% or more, and preferably 70% or more, and more preferably 90% or more, and even more preferably 100% of the total number of the elements, the thickness of the cured coating film on the entire exposed surface of each element can be 1 μm or more, and preferably 3 μm or more, and more preferably 5 μm or more, if needed.

Figure 3:
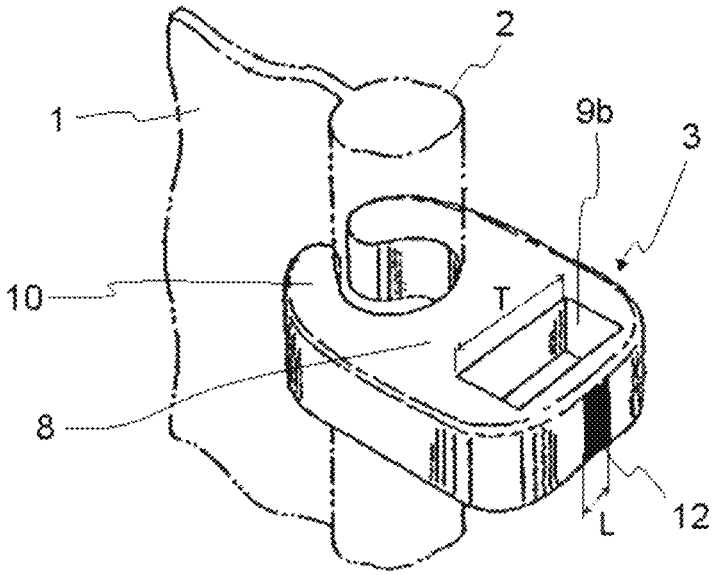
FIG. 3 is another schematic view showing a state where elements are attached to a core portion of a fastener tape.

The central portion 12 in the front and back direction of the fastener tape on the end surface (head tip surface) of the element head portion 8 will be able to be easily understood with reference to FIG. 3. In FIG. 3, a schematic view showing a state where the element 3 is attached to the core portion 2 of the fastener tape 1 is shown from the direction different from that in FIG. 2. The end surface (head tip surface) of the element head portion 8 is a site of the element, which is closest to the opposing fastener stringer when constructing the fastener chain, in other words, a site of the element, which is placed farthest from the fastener tape in the surface direction of the fastener tape. In FIG. 3, the central portion 12 in the front and back direction is the completely blackened part. The length (L) in the front and back direction of the central portion 12 in the front and back direction, on which the cured coating film is continuously formed, is preferably at least 1 mm or more, and more preferably more than or equal to the length (T) in the front and back direction of the engaging concave portion 9*b*.

Further, in a preferred embodiment of the present invention, the measurement of the thickness of the cured coating film on the same site of each element of the fastener stringer demonstrates the high uniformity of the thickness. Because of the high uniformity of the thickness, the fastener stringer having improved stability of the coating film quality can be provided. For example, according to one embodiment of the fastener stringer according to the present invention, the maximum thickness difference of the cured coating film between the top surface centers 11 (there are two locations sandwiching the fastener tape 1) of both leg portions 10 in each element 3 can be within 5 μm, and preferably within 2.5 μm, and more preferably within 2 μm, for example from 1 to 5 μm.

According to another embodiment of the fastener stringer of the present invention, when measuring the thickness of the cured coating film at the top surface center 11 of each leg portion 10 in all the elements 3 of the fastener stringer, the difference between the maximum and minimum values of the thickness of the cured coating film can be within 10 μm, and preferably within 6 μm, and more preferably within 4 μm, and still more preferably within 3 μm, for example from 2 to 10 μm.

According to still another embodiment of the fastener stringer of the present invention, when measuring the thickness of the cured coating film at the top surface centers 11 of each leg portion 10 in all the elements 3 of the fastener stringer, the standard deviation of the thickness can be within 3 μm, and preferably within 2 μm, and more preferably within 1 μm or less, for example from 0.5 μm to 3 μm.

According to still another embodiment of the fastener stringer according to the present invention, when measuring the thickness of the cured coating film at the top surface center 11 of each leg portion 10 in all the elements 3 of the fastener stringer, the coefficient of variation of the thickness can be 0.3 or less, and preferably 0.2 or less, and more preferably 0.15 or less, for example from 0.1 to 0.3.

If the thickness of the cured coating film is larger, the function in accordance with the type of coating film will be more easily exerted. Therefore, according to one embodiment of the fastener stringer of the present invention, when measuring the thickness of the cured coating film at the top surface center 11 of each leg portion 10 in all the elements 3 of the fastener stringer, the average value of the thickness of the cured coating film can be preferably 4 μm or more, and more preferably 5 μm or more, and still more preferably 6 μm or more, and still more preferably 8 μm or more. On the other hand, it is disadvantageous that the thickness of the cured coating film is excessively large, in terms of costs and slidability. Therefore, according to one embodiment of the fastener stringer of the present invention, when measuring the thickness of the cured coating film at the top surface center 11 of each leg portion 10 in all the elements 3 of the fastener stringer, an average value of the thickness of the cured coating film can be preferably 15 μm or less, and more preferably 10 μm or less.

The type of the cured coating film is not particularly limited, but the cured coating film may preferably contain components that will exert various functions such as improvement of the reciprocating opening and closing properties of the slider, improvement of the slidability of the slider, improvement of the discoloration resistance when contacted with the leather (particularly in a case where the element material is a copper alloy), improvement of the alkali resistance (particularly in a case where the element material is an aluminum alloy) and improvement of rust prevention. Examples of the cured coating film exerting such functions include, for example, one or more thermosetting resins selected from polyester-based resin, acrylic-based resin and fluorine-based resin. Among the thermosetting resins, low-temperature curable resins that can be cured generally at from 80 to 150° C., and typically at from 80 to 130° C., are preferred because they can prevent thermal deformation of the tape. The elements can be colored into various color by adding a pigment having desired color to the cured coating film, thereby allowing the need for coloration into various color to be fulfilled.

The slide fastener according to the present invention can be attached to various articles, and particularly functions as an opening/closing tool. The articles to which the slide fastener is attached include, but not limited to, daily necessities such as clothing items, bags, shoes and miscellaneous goods, as well as industrial goods such as water storage tanks, fishing nets and space suites.

A preferred method for producing the slide fastener according to the present invention includes an electrodeposition coating method in which the cured coating film of the aqueous coating material is formed on the row of the elements attached to the fastener tape. The electrodeposition coating method comprises the steps of 1) preparing a fastener stringer comprising the row of the elements and the fastener tape, at least one side edge of the fastener tape having insulation properties, the row of the elements having conductivity at least on their exposed surface and being attached to the one side edge of the fastener tape, or preparing a fastener chain in which the rows of the elements of a pair of the fastener stringers are engaged with each other; 2) sequentially immersing the row of the elements in a positively or negatively charged aqueous coating material bath while conveying the fastener stringer or the fastener chain; and 3) forming cured coating film on the elements by bringing the elements immersed in the aqueous coating material bath into contact with an electrode having a charge opposite to that of the aqueous coating material bath.

The conveying of the fastener stringer or the fastener chain can be carried out by a roll-to-roll conveyer. For the electrodeposition coating, either cationic electrodeposition or anionic electrodeposition may be employed, but the anionic electrodeposition is preferred in terms of external appearance. The coating film is formed by sequentially contacting an electrode having a charge opposite to that of the aqueous coating bath with each element which is moving while being immersed in the aqueous coating bath for desired period of time.

After the electrodeposition coating, aqueous coating material adhered to the fastener tape and/or any excess aqueous coating material adhered to the elements may be washed with water for removal as needed. However, the coating film adhered to the element surface has higher adhesiveness because the coating film is electrochemically deposited, and does not easily elute even if the film is washed with water. It is also possible to suck and remove the aqueous coating material adhered to the fastener tape and/or the excess aqueous material adhered to the elements before and/or after washing with water.

Furthermore, after the electrodeposition coating, the coating film can be cured by baking the coating film. When the baking is carried out, it may be preferably carried out at 150° C. or less, and more preferably at 130° C. or less, such that the fastener tape is not thermally deformed. However, the baking can be also carried out at a higher temperature by protecting the fastener tape with a masking tape or the like. The baking can be also carried out without removing the aqueous coating material adhered to the fastener tape. In this case, the cured coating film can be also formed on the fastener tape.

As the method of forming the cured coating film of the aqueous coating material on the row of the elements attached to the fastener tape, a method of forming the cured coating film by a self-deposition type coating using a potential difference in the coating solution can be considered in addition to the electrodeposition coating method using the external power source as stated above.

EXAMPLES

Hereinafter, Examples of the present invention are illustrated, but they are provided for better understanding of the present invention and its advantages, and are not intended to limit the present invention.

Inventive Example 1

<Preparation of Fastener Chain>

A row of metallic elements made of red brass was fixed by means of caulking to one side edge of a fastener tape made of polyester to produce a continuous fastener stringer, and the opposing elements of a pair of the fastener stringers were engaged with each other to produce a fastener chain.

The fastener chain was continuously conveyed by a roll-to-roll conveyer. During being conveyed, the fastener chain was passed through an aqueous coating material bath, during which, each element was sequentially contacted with a positive electrode to apply anionic electrodeposition coating to the rows of the elements. The electrodeposition coating in this case was carried out under the following conditions:

<Conditions for Electrodeposition Coating>

(1) Conveyance speed of the fastener chain: 5 m/min.;

(2) Applied voltage: 240V;

(3) Aqueous coating material: a coating material obtained by adding 3 parts by mass of a red pigment to 100 parts by mass of a low-temperature curable polyester resin coating material.

After passing through the aqueous coating material bath, the aqueous coating material adhered to the fastener tape was removed by washing with water while conveying the fastener chain with the roll-to-roll conveyer, and baking was finally carried out. The baking was carried out by heating the fastener chain at 130° C. for 15 minutes, thereby curing the electrodeposition coating film on the elements. The fastener chain having the cured coating film of the aqueous coating material on the element surface was thus produced.

The exposed surface of the elements of the resulting fastener chain was observed by a microscope (VHX-2000 available from KEYENCE CORPORATION) to confirm that the entire surface of all the elements had the cured coating film with red color. Further, some elements were removed from the fastener tape and the thickness of the coating film on each site was confirmed by cross-sectional observation, showing that, even on the bottom surface of the engaging concave portion, which had the thinnest cured coating film, the cured coating film having the thickness of 2 μm or more was formed. However, for each element, the inside of the leg portion, which was hidden in contact with the core portion of the fastener tape, did not have any electrodeposition coating film.

Further, five samples of the elements on which the cured coating film was formed by the above testing were taken, and the thickness of the coating film at the top surface centers of both leg portions of each element was measured by cross-sectional observation with a microscope (VHX-2000 available from KEYENCE CORPORATION) for each sample. For convenience, the leg portion of each element on one surface side of the fastener tape refers to a first leg portion, and the leg portion of each element on the other side of the fastener tape refers to a second leg portion. The results are shown in Tables 1 to 3. Table 1 describes the film thickness of each leg portion for each sample, Table 2 describes the maximum film thickness difference, average, standard deviation and coefficient of variation of the thickness of the coating film for each of the first and second leg portions in all samples, and Table 3 describes the maximum film thickness difference, average, standard deviation and coefficient of variation of the thickness of the coating film for the whole leg portion in all samples. In addition, it was confirmed that similar results could be obtained even if the number of samples of the elements was increased. Further, a fastener chain with an element surface coated with clear coat was also able to be produced by forming coating film without adding any pigment to the aqueous coating material in a similar manner.

TABLE 1

| Sample Nos. | First Leg Portion (μm) | Second Leg Portion (μm) |
|---|---|---|
| 1-1 | 10.1 | 9.1 |
| 1-2 | 8.4 | 9.8 |
| 1-3 | 9.6 | 9.1 |
| 1-4 | 7.7 | 8.9 |
| 1-5 | 7.4 | 7.9 |

TABLE 2

| | Whole First Leg Portion (μm) | Whole Second Leg Portion (μm) |
|---|---|---|
| Maximum Film Thickness Difference | 2.7 | 1.9 |
| Average | 8.6 | 9.0 |
| Standard Deviation (σ) | 1.1 | 0.6 |
| Coefficient of Variation | 0.13 | 0.07 |

TABLE 3

| | Whole Leg Portion (μm) |
|---|---|
| Maximum Film Thickness Difference | 2.7 |
| Average | 8.8 |
| Standard deviation (σ) | 0.9 |
| Coefficient of Variation | 0.10 |

(Verification of Removal Performance Effect of Aqueous Coating Material by Washing with Water)

<Washed>

A fastener chain before electrodeposition coating was prepared in the same manner as Inventive Example 1, which was cut such that the area in one side of the tape portion was 280 $cm^2$, and immersed in the aqueous coating material as in Inventive Example 1 in a state with no electric conduction, and the aqueous coating material was allowed to flow for 1 minute to deposit the aqueous coating material to the fastener tape. The fastener tape was then washed for 5 minutes by placing the tape in a water washing tank with vibrating. The fastener tape was then removed from the water washing tank and dried for 15 minutes in an environment at 130° C.

<Non-Washed>

The aqueous coating material was deposited to the fastener tape under the same conditions as the case of washing and then dried for 15 minutes in an environment at 130° C. without water washing.

The effect of removing the coating material by washing with water was confirmed by comparing the weight of the washed fastener tape with that of the non-washed fastener tape. The results are shown in Table 4.

TABLE 4

| | Washed | Non-washed |
|---|---|---|
| Before immersion in the coating material (Total Weight) | 24.5587 g | 24.7503 g |
| After drying (Total Weight) | 24.5888 g | 25.3684 g |
| Residue (Difference of The Above Weights) | 30 mg | 618 mg |
| Residue (Per Unit Area) | 0.1 mg/cm$^2$ | 2.2 mg/cm$^2$ |

Comparative Example 1

Roll Coating Method 1

A row of metallic elements made of red brass was fixed by means of caulking to one side edge of a fastener tape made of polyester to produce a continuous fastener stringer, and the opposing elements of a pair of the fastener stringers were engaged with each other to produce a fastener chain.

The fastener chain was then continuously transported by a roll-to-roll conveyer. During being transported, a lacquer composition was selectively coated to the elements by passing the fastener chain through a roll coater, and then dried to form a cured coating film.

Five samples of the elements on which the cured coating film was formed by the roll coating method were taken, and the thickness of the coating film at the top surface centers of both leg portions of each element was measured by cross-sectional observation with a microscope (VHX-2000 available from KEYENCE CORPORATION) for each sample, as in Inventive Example 1. The results are shown in Tables 5 to 7. Table 5 describes the film thickness of each leg portion for each sample, Table 6 describes the maximum film thickness difference, average, standard deviation and coefficient of variation of the thickness of the coating film for each of the first and second leg portions in all samples, and Table 7 describes the maximum film thickness difference, average, standard deviation and coefficient of variation of the thickness of the coating film for the whole leg portion in all samples. In addition, for all the elements on which the cured film was formed by the roll coating method, no cured coating film was formed at the center portion of the front and back direction of the fastener tape on the end surface portion of the element head portion and the engaging concave portion of the element head portion.

TABLE 5

| Sample Nos. | First Leg Portion (μm) | Second Leg Portion (μm) |
|---|---|---|
| 2-1 | 9.9 | 6.5 |
| 2-2 | 4.4 | 8.7 |
| 2-3 | 15.5 | 10.7 |
| 2-4 | 5.9 | 11.5 |
| 2-5 | 5.5 | 5.0 |

TABLE 6

| | Whole First Leg Portion (μm) | Whole Second Leg Portion (μm) |
|---|---|---|
| Maximum Film Thickness Difference | 11.1 | 6.5 |
| Average | 8.2 | 8.5 |
| Standard Deviation (σ) | 4.1 | 2.5 |
| Coefficient of Variation | 0.50 | 0.29 |

TABLE 7

| | Whole Leg Portion (μm) |
|---|---|
| Maximum Film Thickness Difference | 11.1 |
| Average | 8.4 |
| Standard Deviation (σ) | 3.6 |
| Coefficient of Variation | 0.43 |

Comparative Example 2

Roll Coating Method 2

A row of metallic elements made of red brass was fixed by means of caulking to one side edge of a fastener tape made of polyester to produce a continuous fastener stringer, and the opposing elements of a pair of the fastener stringers were engaged with each other to produce a fastener chain.

The fastener chain was then continuously conveyed by a roll-to-roll conveyer. During being conveyed, an epoxy-based clear coating material was selectively coated to the elements by passing the fastener chain through a roll coater, and then dried to form a cured coating film.

Five samples of the elements on which the cured coating film was formed by the roll coating method were taken, and the thickness of the coating film at the top surface centers of both leg portions of each element was measured by cross-sectional observation with a microscope (VHX-2000 available from KEYENCE CORPORATION) for each sample, as in Inventive Example 1. The results are shown in Tables 8 to 10. Table 8 describes the film thickness of each leg portion for each sample, Table 9 describes the maximum film thickness difference, average, standard deviation and coefficient of variation of the thickness of the coating film for each of the first and second leg portions in all samples, and Table 10 describes the maximum film thickness difference, average, standard deviation and coefficient of variation of the thickness of the coating film for the whole leg portion in all samples. In addition, for all the elements on which the cured film was formed by the roll coating method, no cured coating film was formed at the center portion of the front and back direction of the fastener tape on the end surface portion of the element head portion and the engaging concave portion of the element head portion.

TABLE 8

| Sample Nos. | First Leg Portion (μm) | Second Leg Portion (μm) |
|---|---|---|
| 3-1 | 23.0 | 9.1 |
| 3-2 | 21.8 | 10.7 |
| 3-3 | 17.2 | 14.0 |

TABLE 8-continued

| Sample Nos. | First Leg Portion (μm) | Second Leg Portion (μm) |
|---|---|---|
| 3-4 | 22.4 | 12.7 |
| 3-5 | 18.5 | 9.4 |

TABLE 9

| | Whole First Leg Portion (μm) | Whole Second Leg Portion g (μm) |
|---|---|---|
| Maximum Film Thickness Difference | 5.8 | 4.9 |
| Average | 20.6 | 11.2 |
| Standard Deviation (σ) | 2.3 | 1.9 |
| Coefficient of Variation | 0.11 | 0.17 |

TABLE 10

| | Whole Leg Portion (μm) |
|---|---|
| Maximum Film Thickness Difference | 13.9 |
| Average | 15.9 |
| Standard Deviation (σ) | 5.4 |
| Coefficient of Variation | 0.34 |

As can be seen from the data of the film thickness for Inventive Example 1, Comparative Example 1 and Comparative Example 2, the elements according to the present invention have very high uniformity of the thickness of the cured coating film.

Inventive Example 2

A fastener chain having cured coating film of an aqueous coating material on the surface of elements was produced under the same conditions as in Inventive Example 1, with the exception that metal elements made of an aluminum alloy was used as the metal elements.

Figure 4A:
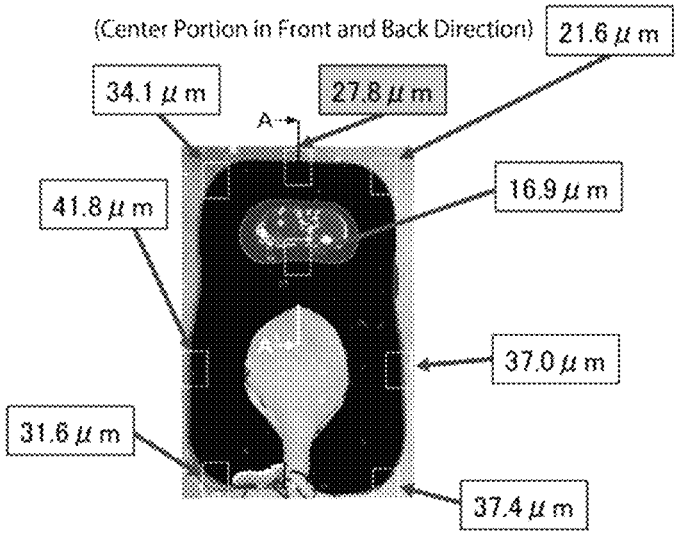
FIG. 4A is a lateral cross-sectional photograph of an element subjected to electrodeposition coating according to Inventive Example 2.
Figure 4B:
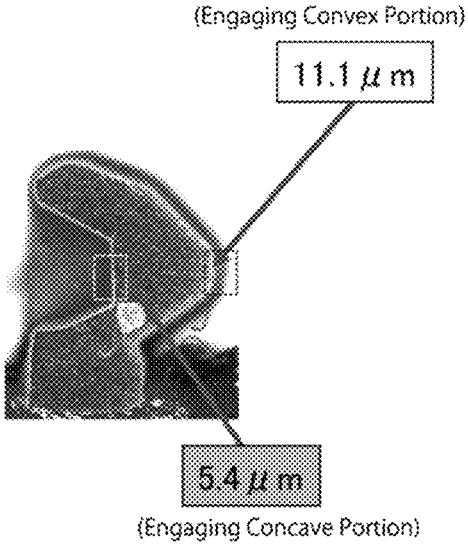
FIG. 4B is a longitudinal cross-sectional photograph taken along the line A-A' in FIG. 4A.

The exposed surface of the elements of the resulting fastener chain was observed by a microscope (VHX-2000 available from KEYENCE CORPORATION) to confirm that the entire surface of all the elements had the cured coating film having red color. Further, some elements were removed from the fastener tape and the thickness of the coating film in each site was confirmed by cross-sectional observation, showing that, even on the bottom surface of the engaging concave portion, which had the thinnest cured coating film, the cured coating film having the thickness of 5 μm or more was formed. However, for each element, the inside of the leg portion, which was hidden in contact with the core portion of the fastener tape, did not have any electrodeposition coating film. FIG. 4A is a lateral cross-sectional photograph of the element, FIG. 4B is a longitudinal cross-sectional photograph taken along the line A-A' in FIG. 4A. They shows that even at the center portion in the front and back direction of the fastener tape (see FIG. 4A) and the engaging concave portion (see FIG. 4B) which are difficult to form the cured coating film by the roll coating, the cured coating film was formed. Further, a fastener chain having the element surface coated with clear coat was also able to be produced by forming the coating film without adding any pigment to the aqueous coating material.

DESCRIPTION OF REFERENCE NUMERALS

1 fastener tape
2 core portion
3 elements
4 upper stopper
5 lower stopper
6 slider
7 slide fastener chain
8 head portion
9*a* engaging convex portion
9*b* engaging concave portion
10 leg portion
11 top surface center of leg portion

What is claimed is:

1. A fastener stringer comprising a row of elements and a fastener tape, at least one side edge of the fastener tape having insulation properties, the row of the elements being attached to the one side edge of the fastener tape, wherein each element comprises a pair of leg portions for holding the fastener tape from front and back sides; and a head portion connecting each leg portion while straddling the one side edge of the fastener tape, the head portion having an engaging region for engaging with an opposing element when constructing a fastener chain; and wherein cured coating film is formed in 50% or more of a total number of the elements at least at a center portion in a front and back direction of the fastener tape on an end surface of the head portion.

2. The fastener stringer according to claim 1, wherein the head portion of each element has an engaging convex portion and an engaging concave portion for engaging with the opposing element when constructing the fastener chain, wherein the engaging convex portion is formed so as to protrude toward one side in an element arranging direction, the engaging concave portion is formed on the other side opposite to the engaging convex portion in the element arranging direction, and the cured coating film is formed in 50% or more of the total number of the elements at least on the engaging concave portion.

3. The fastener stringer according to claim 1, wherein the cured coating film is formed on an entire conductive exposed surface of each element.

4. The fastener stringer according to claim 1, wherein, in each element, a maximum thickness difference of the cured coating film between top surface centers of the both leg portions is within 2 μm.

5. The fastener stringer according to claim 1, wherein, when measuring a thickness of the cured coating film at a top surface center of each leg portion in all the elements of the fastener stringer, a difference between maximum and minimum values of the thickness of the cured coating film is within 10 μm.

6. The fastener stringer according to claim 1, wherein, when measuring a thickness of the cured coating film at a top surface center of each leg portion in all the elements of the fastener stringer, a standard deviation of the thickness of the cured coating film is within 3 μm.

7. The fastener stringer according to claim 1, wherein, when measuring a thickness of the cured coating film at a top surface center of each leg portion in all the elements of the fastener stringer, an average value of the thickness of the cured coating film is from 5 to 15 μm.

8. The fastener stringer according to claim 1, wherein, when measuring a thickness of the cured coating film at a top surface center of each leg portion in all the elements of the fastener stringer, a coefficient of variation of the thickness of the cured coating film is 0.3 or less.

9. The fastener stringer according claim 1, wherein the cured coating film comprises a resin component of one or more thermosetting resins selected from polyester-based resin, acrylic-based resin and fluorine-based resin.

10. The fastener stringer according to claim 1, wherein the cured coating film contains a pigment and/or a dye.

11. A fastener chain comprising the fastener stringer according to claim 1 and a second fastener stringer, in which the row of elements of the fastener stringer is engaged with a row of elements of the second fastener stringer.

12. A slide fastener comprising the fastener stringer according to claim 1.

13. An article comprising the slide fastener according to claim 12.

14. A method for electrodeposition-coating a row of elements attached to a fastener tape, comprising steps of:

1) preparing a fastener stringer comprising the row of the elements and the fastener tape, at least one side edge of the fastener tape having insulation properties, the row of the elements having conductivity at least on their exposed surface and being attached to the one side edge of the fastener tape, or preparing a fastener chain in which the rows of the elements of a pair of the fastener stringers are engaged with each other;
2) sequentially immersing the row of the elements in a positively or negatively charged aqueous coating material bath while conveying the fastener stringer or the fastener chain; and
3) forming cured coating film on the elements by bringing the elements immersed in the aqueous coating material bath into contact with an electrode having a charge opposite to that of the aqueous coating material bath.

15. The method according to claim 14, further comprising, after the step 3), the step 4) of water-washing and removing the aqueous coating material adhered to the fastener tape.

16. The method according to claim 14, further comprising, after the step 3), the step 5) of baking the coating film to cure the coating film.

* * * * *